US008111867B2

(12) United States Patent
Wu

(10) Patent No.: US 8,111,867 B2
(45) Date of Patent: Feb. 7, 2012

(54) ELECTRONIC DEVICE WITH A SPEAKER

(75) Inventor: Chin-Hung Wu, Taipei County (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 871 days.

(21) Appl. No.: 12/170,524

(22) Filed: Jul. 10, 2008

(65) Prior Publication Data

US 2009/0169046 A1 Jul. 2, 2009

(30) Foreign Application Priority Data

Dec. 27, 2007 (CN) ..... 2007 1 0203490

(51) Int. Cl.
*H04R 1/02* (2006.01)

(52) U.S. Cl. ..... 381/394; 381/332; 381/334; 381/386; 381/411; 455/575.1

(58) Field of Classification Search ..... 381/394–395, 381/386, 392, 332, 334–335, 411, 345, 409; 455/575.1; 361/679.01
See application file for complete search history.

(56) References Cited

U.S. PATENT DOCUMENTS

| | | | | |
|---|---|---|---|---|
| 5,201,069 | A * | 4/1993 | Barabolak | 455/575.1 |
| 5,980,335 | A * | 11/1999 | Barbieri et al. | 439/824 |
| 2007/0155216 | A1* | 7/2007 | Juan et al. | 439/352 |
| 2008/0144879 | A1* | 6/2008 | Yang et al. | 381/386 |

FOREIGN PATENT DOCUMENTS

CN 1071794 A 5/1993

* cited by examiner

*Primary Examiner* — Michael Trinh
(74) *Attorney, Agent, or Firm* — Altis Law Group, Inc.

(57) ABSTRACT

An electronic device (100) having a speaker (30) located in a sealed and separate speaker enclosure is described. The electronic device includes a housing (20), a circuit board (70), a cover (60), and two connecting bodies (50). The housing includes a cavity (22) defined therein for receiving the speaker. The circuit board is electrically connected to the speaker. The cover has through holes (622) defined thereon and is disposed between the housing and the circuit board. In addition, one end of the connecting bodies connects to the speaker, and the other end of the connecting bodies is configured to resist the circuit board via the through holes to electrically connect the speaker and the circuit board.

11 Claims, 6 Drawing Sheets

ELECTRONIC DEVICE WITH A SPEAKER

BACKGROUND

1. Field of the Invention

The present invention relates to an electronic device equipped with a speaker.

2. Discussion of the Related Art

With the rapid development of technologies, the design of electronic devices, such as cellular phones, PDAs (personal digital assistants), and so on, is being driven by the marketplace towards providing more and more multimedia functions. At the same time, consumer and user demand has continued to push a dramatic reduction in the size of electronic devices.

To comply with the multimedia requirements, most electronic devices today include a speaker. Quality of the sound from speakers strongly influences customers buying decisions.

FIG. 4 shows a typical electronic device including a housing 12, a speaker 14, a washer 16, and a circuit board 18. The housing includes a chamber 122 defined therein for receiving the speaker 14. The speaker 14 includes a diaphragm 142 and a conductive surface 144 opposite to the diaphragm 142. The diaphragm 142 is an outer surface of the speaker 14 for propagating sounds. The conductive surface 144 is an internal surface for electrically connecting the speaker 14 to the circuit board 18. Two elastic sheets 146 are protrusively arranged on the conductive surface 144 for resisting the circuit board 18 to electrically connect the speaker 14 to the circuit board 18.

FIGS. 5 and 6 show the typical electronic device with the speaker 14 arranged therein. The diaphragm 142 is close to a bottom of the chamber 122 and a plurality of vent holes are defined in the bottom of chamber 122. The elastic bodies 146 electrically connect the speaker 14 to the circuit board 18. The washer 16 is arranged on a top of sidewalls of the chamber 122. However, as electronic components are mainly arranged in a middle portion of the circuit board 18, edges of the circuit board 18 will be slightly raised due to the weight of the electronic components. In this way, interstices 124 between the chamber 122 and the circuit board 18 result in sound leakage. The leaked sounds interfere with the sounds dissipating from the vent holes of the chamber 122 and decrease the overall sound quality of the electronic device. One solution to solve the above problems is to provide an airtight chamber for the speaker 14. However, the need for the airtight chamber of the electronic device conflicts with the drive to produce smaller devices.

In addition, the speaker 14 is electrically connected to the circuit board 18 using the elastic bodies 146 as shown in FIG. 5. It is difficult to precisely position the elastic bodies 146 during assembly. Moreover, the circuit board 18 may be damaged due to great elasticity of the elastic bodies 146.

Therefore, there is room for improvement within the art.

BRIEF DESCRIPTION OF THE DRAWINGS

Many aspects of the electronic device can be better understood with reference to the following drawings. The components in the drawings are not necessarily to scale, the emphasis instead being placed upon clearly illustrating the principles of the present electronic device. Moreover, in the drawings, like reference numerals designate corresponding parts throughout the several views.

DETAILED DESCRIPTION OF THE EMBODIMENTS

Figure 1:
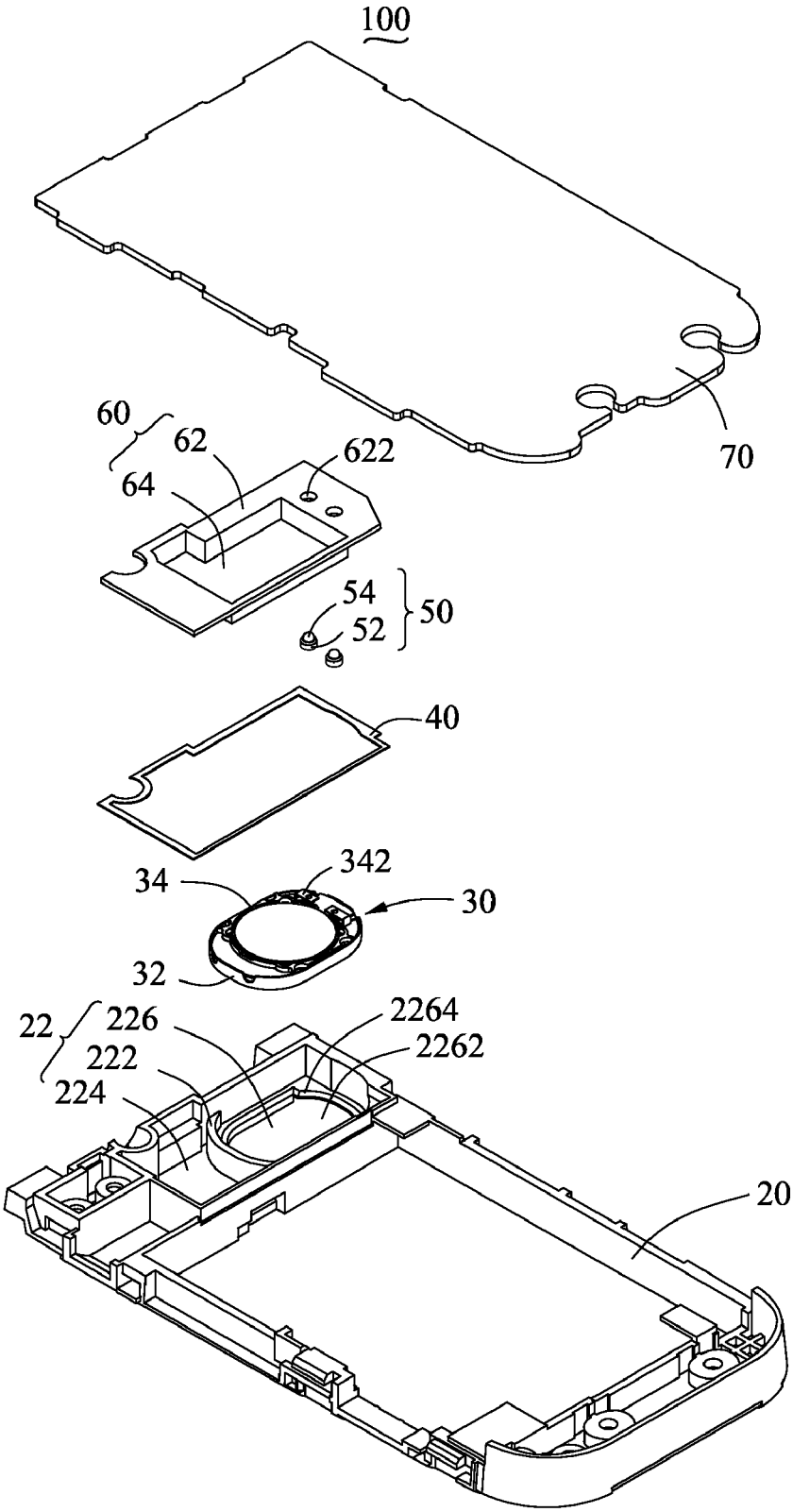
FIG. 1 is an isometric view of an electronic device according to an exemplary embodiment.

FIG. 1 shows an electronic device 100 including a housing 20, a speaker 30, an adhesive layer 40, two connecting bodies 50, a cover 60, and a circuit board 70.

A substantially rectangular cavity 22 is defined in one end of the housing 20 and is divided into a first chamber 224 and a second chamber 226 by an arcuate plate 222. The first chamber 224 is for enclosing electronic components therein and the second chamber 226 is for accommodating the speaker 30. The height of the arcuate plate 222 is lower than sidewalls of the cavity 22. The second chamber 226 includes a bottom 2262 and peripheral edges 2264. A plurality of vent holes are defined in the bottom 2262 (not shown) of the second chamber 226. However, the plurality of vent holes may be defined in sidewalls of the second chamber 226. The peripheral edges 2264 are defined on a lower part of the sidewalls of the second chamber 226.

The speaker 30 is an independent component for receiving electrical signals from the circuit board 70 and convert the electric signals into acoustic signals. In the exemplary embodiment, the thickness of the speaker 30 is less than the depth of the second chamber 226, and substantially equals the height of the arcuate plate 222. The speaker 30 includes a diaphragm 32 and a connecting surface 34 opposite to the diaphragm 32. The acoustic signals drive the diaphragm 32 of the speaker 30 to oscillate to generate sound waves. The sound waves are propagated by the plurality of vent holes defined in the bottom 2262 of the second chamber 226. The dimension of the diaphragm 32 substantially equals that of the bottom 2262 so the speaker 30 is engageable with the second chamber 226. In addition, the connecting surface 34 further includes two elastic sheets 342 arranged in peripheral portions for electrically connecting to the circuit board 70.

The adhesive layer 40 is formed according to the shape of the cavity 22. The adhesive layer 40 attaches the cover 60 to the cavity 22 to completely seal the cavity 22.

Each of the connecting bodies 50 includes a base 52 and an adjustable rod 54. The connecting bodies 50 may be elastic pins, such as pogo pins. The bases 52 are substantially cylindrical with a larger diameter than the adjustable rods 54. One end of each adjustable rod 54 is affixed within a corresponding base 52, and the other end of each adjustable rod 54 protrudes out from the base 52. The adjustable rods 54 may extend from the bases 52 and bend back to the base 52.

The cover 60 is formed by punching a plate. The cover 60 includes a recess 64 and horizontal edges 62 surrounding the recess 64. One end of the horizontal edges 62 has two circular-shaped through holes 622 defined thereon. The distance between the through holes 622 substantially equals to the distance between the two elastic sheets 342 of the connecting surface 34. The diameter of the through holes 662 is smaller than the diameter of the bases 52 of the connecting bodies 50, but is larger than the diameter of the adjustable rods 54 of the connecting bodies 50. A bottom of the recess 64 is configured for being resisted against by the connecting surface 34 of the speaker 30.

The circuit board 70 is a substantially rectangular-shaped board. The dimension of the circuit board 70 equals a top surface of the housing 20 so that the housing 20 and the circuit board 70 are engageable with each other as shown in FIG. 2.

In assembly, the bases 52 of the connecting bodies 50 are respectively attached to the elastic sheets 342 to electrically connect the connecting bodies 50 to the speaker 30. The diaphragm 32 of the speaker 30 is then engaged with the bottom 2262 to install the speaker 30 in the second chamber 226. The connecting surface 34 of the speaker 30 is slightly lower than the arcuate plate 222. The cover 60 is then attached to the cavity 22 using the adhesive layer 40 to seal the cavity 22. In this way, a bottom of the recess 64 of the cover 60 is arranged to resist the connecting surface 34 of the speaker 30 and the top surface of the arcuate plate 222. Further, the adjustable rods 54 of the connecting bodies 50 are arranged to pass through the through holes 622 of the cover 60 respectively. Finally, the circuit board 70 is attached to the housing 20 and the adjustable rods 54 of the connecting bodies 50 are arranged to resist the circuit board 70 to electrically connect the speaker 30 to the circuit board 70.

Figure 2:
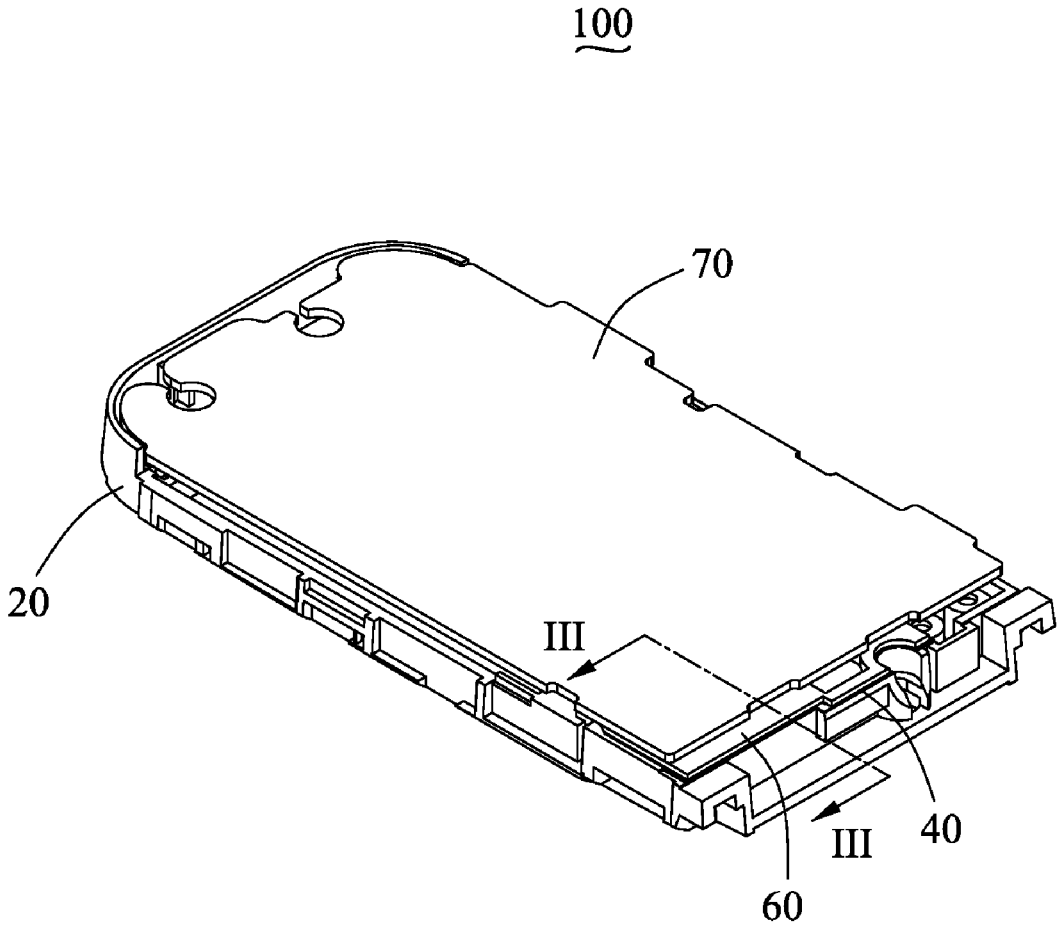
FIG. 2 is an assembled view showing the electronic device in FIG. 1.
Figure 3:
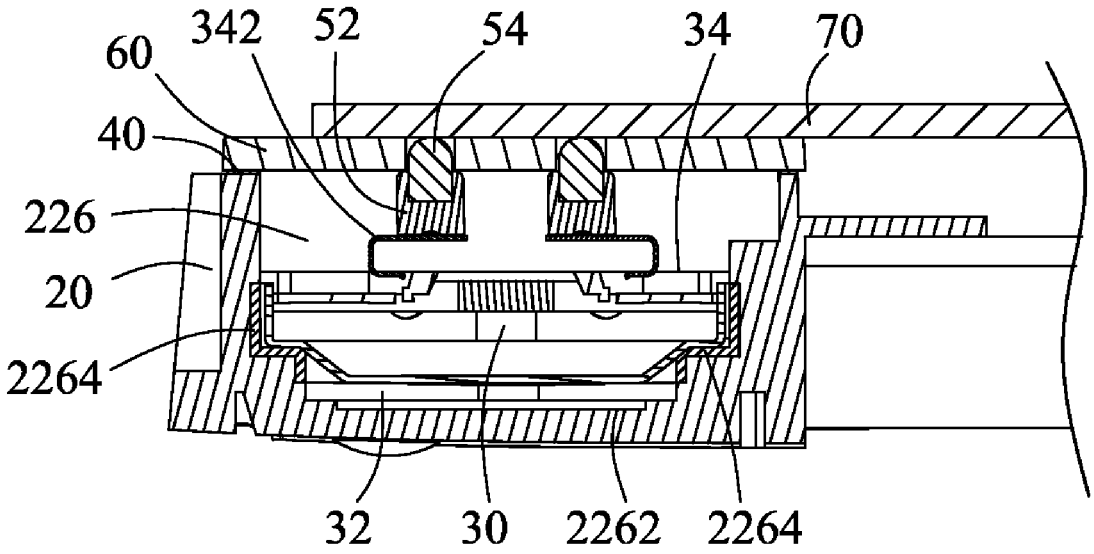
FIG. 3 is a cross-sectional view taken along line VI-VI of FIG. 2.
Figure 4:
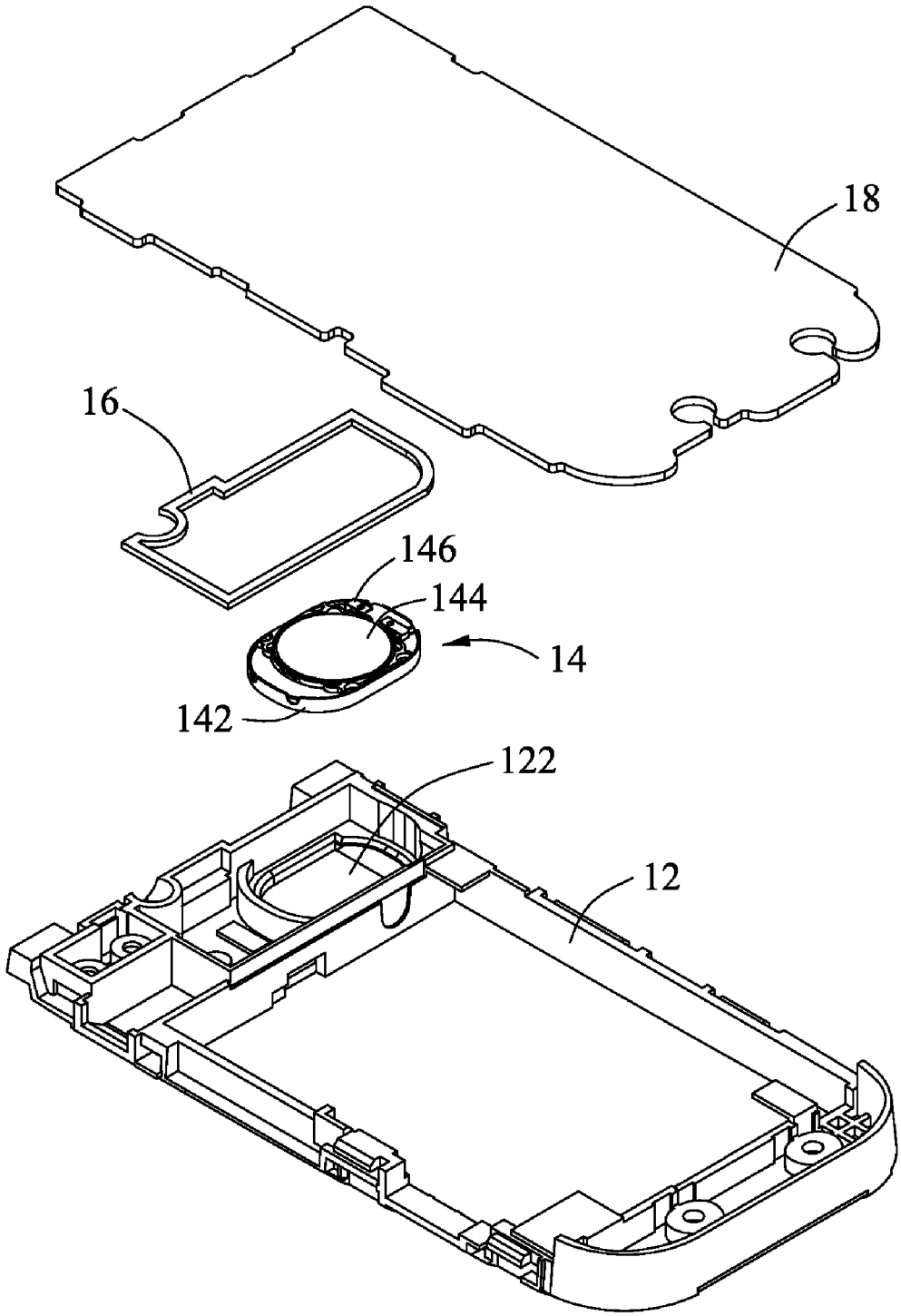
FIG. 4 (RELATED ART)
FIG. 4 is an isometric view of a typical electronic device.
Figure 5:
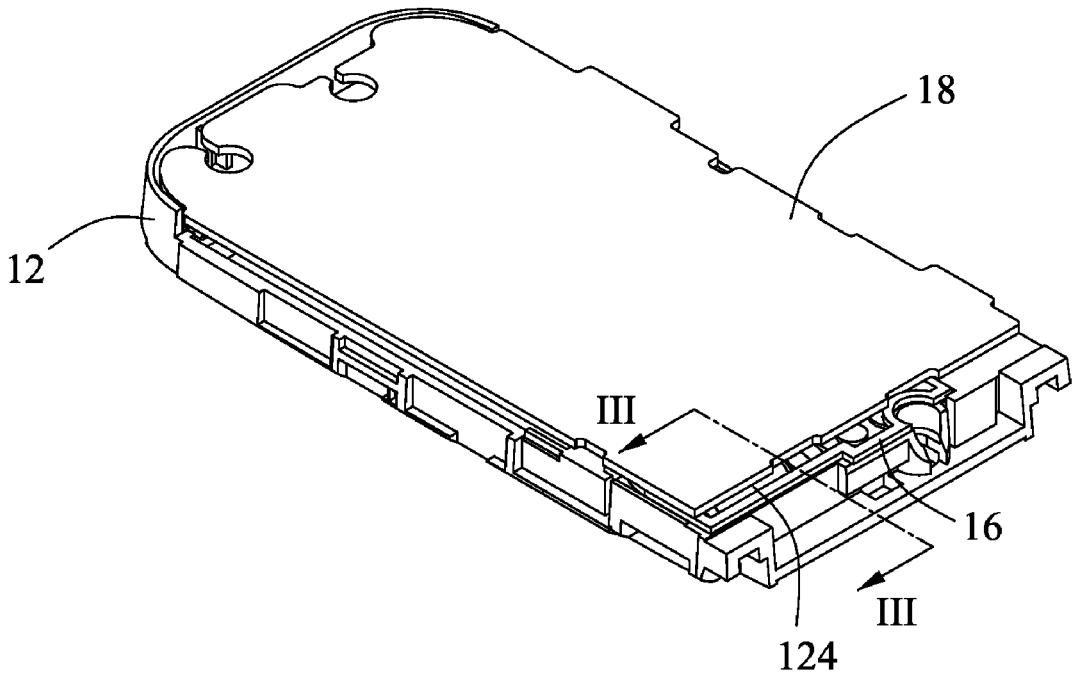
FIG. 5 (RELATED ART)
FIG. 5 is an assembled view showing the typical electronic device in FIG. 2.
Figure 6:
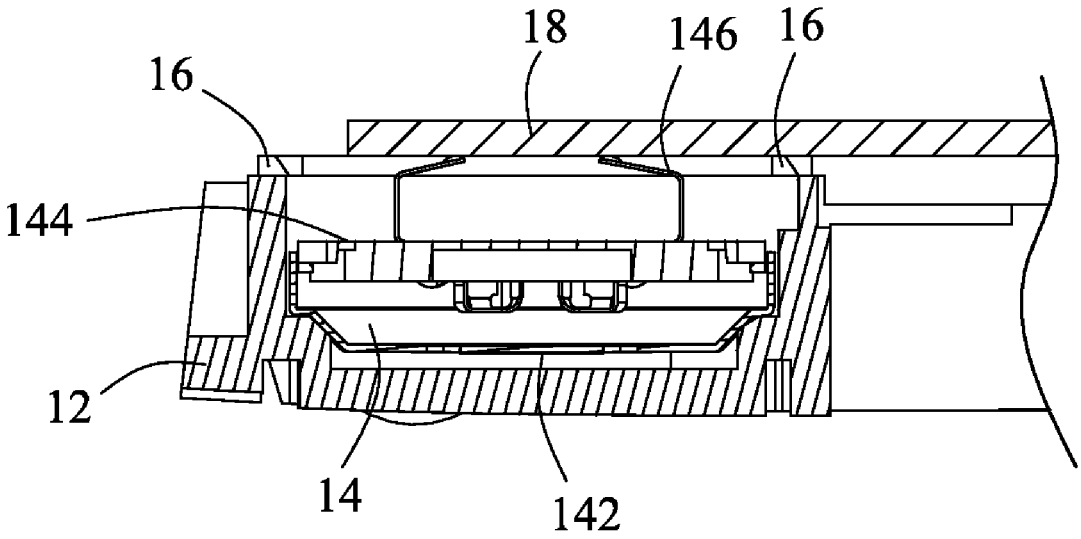
FIG. 6 (RELATED ART)
FIG. 6 is a cross-sectional view taken along line III-III of FIG. 5.

Referring to FIGS. 2 and 3, the assembled electronic device 100 is shown. The diaphragm 32 of the speaker 30 is located close to the bottom 2262 of the second chamber 226. The speaker 30 is arranged to be engageable with the peripheral edges 2264 of the second chamber 226. The bases 52 of the connecting bodies 50 are attached to the elastic sheets 342 of the speaker 30 so the adjustable rods 54 are electrically connected to the elastic sheets 342. As the diameter of the bases 52 is larger than the diameter of the through holes 622, the bases 52 are configured to elastically resist the cover 60 by the elastic sheets 342 of the connecting surface 34. The through holes 622 also contribute orienting the connecting bodies 50 and the circuit board 70 to simplify the assembly process. Further, the adjustable rods 54 pass through the cover 60 to resist the circuit board 70 thereby electrically connecting the speaker 30 and the circuit board 70. In this way, the elasticity generated by the elastic sheets 342 is restrained by the cover 60, and thus the circuit board 70 will not be deformed from resistance of the adjustable rods 54.

From the foregoing it will be seen that the speaker 30 of the embodiment is installed in an air-tight cavity 22 that functions as an independent speaker enclosure. In this way, the speaker 30 provides a higher fidelity sound without leaking or sizzling.

In alternative embodiments, each of the elastic sheets 342 of the speaker 30 and each of the connecting bodies 50 may be integrally formed on the connecting surface 34 of the speaker 30. In addition, the elastic sheets 342 of the speaker 30 may be emitted by directly soldering the bases 52 of the connecting bodies 50 on the speaker 30.

The connecting bodies 50 may be arranged on the cover 60 in advance. One end of the connecting bodies 50 resists the circuit board 70, and the other end of the connecting bodies 50 resists the connecting surface 34 of the speaker 30. In addition, the cover 60 may be a plate-like structure without recess 64 defined thereon.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An electronic device having a speaker, comprising:

a housing having a cavity defined therein for receiving the speaker;

a circuit board being electrically connected to the speaker;

a cover secured to the housing, the cover having through holes defined therein, the through holes being disposed between the housing and the circuit board; and at least one connecting body, each of the at least one connecting body comprising a base and an adjustable rod retractable extending from the base, the base being connected to the speaker and resisting against the cover to be completely positioned outside and seal the corresponding one through hole, the adjustable rod being received and passing through the corresponding one through hole and resisting the circuit board to electrically connect the speaker and the circuit board;

wherein the securing of the cover to the housing and the sealing of the base to the through hole cooperatively seal the cavity of the housing to be air-tight.

2. The electronic device as claimed in claim 1, wherein the cavity is divided into a first chamber and a second chamber by a plate, the first chamber enclosing electronic components and the second chamber receiving the speaker.

3. The electronic device as claimed in claim 2, wherein the second chamber comprises a bottom and peripheral edges, the bottom includes a plurality of vent holes defined thereon, and the height of the plate equals the thickness of the speaker.

4. The electronic device as claimed in claim 2, wherein the speaker further comprises a diaphragm and a connecting surface opposite to the diaphragm, and two elastic sheets are arranged on the connecting surface.

5. The electronic device as claimed in claim 4, wherein the diaphragm of the speaker is located adjacent to the bottom of the second chamber.

6. The electronic device as claimed in claim 4, wherein the base is attached to the elastic sheet, the diameter of the base is larger than the diameter of the adjustable rods, one end of the adjustable rod is affixed within the base, and the other end of the adjustable rod protrudes out from the base.

7. The electronic device as claimed in claim 1, wherein the cover further comprises a recess and horizontal edges with the two through holes defined thereon, and a bottom of the recess is for being resisted against by the speaker.

8. The electronic device as claimed in claim 7, wherein the diameter of the through holes is smaller than the diameter of the bases and larger than the diameter of the adjustable rod.

9. The electronic device as claimed in claim 6, wherein the adjustable rods pass through the through holes to resist the circuit board.

10. The electronic device as claimed in claim 1, wherein the electronic device further comprises an adhesive layer for attaching the cover to the cavity.

11. The electronic device as claimed in claim 1, wherein the connecting bodies are generally elastic pins.

* * * * *